US010456943B2

(12) United States Patent
King et al.

(10) Patent No.: US 10,456,943 B2
(45) Date of Patent: Oct. 29, 2019

(54) MACHINES AND METHODS FOR CUTTING PRODUCTS AND IMPELLERS THEREFOR

(71) Applicant: Urschel Laboratories, Inc., Chesterton, IN (US)

(72) Inventors: Daniel Wade King, Valparaiso, IN (US); Fut Meng Wong, Singapore (SG)

(73) Assignee: Urschel Laboratories, Inc., Chesterton, IN (US)

( * ) Notice: Subject to any disclaimer, the term of this patent is extended or adjusted under 35 U.S.C. 154(b) by 206 days.

(21) Appl. No.: 14/957,157

(22) Filed: Dec. 2, 2015

(65) Prior Publication Data

US 2016/0158953 A1 Jun. 9, 2016

Related U.S. Application Data

(60) Provisional application No. 62/086,782, filed on Dec. 3, 2014.

(51) Int. Cl.

| | |
|---|---|
| ***B26D 7/06*** | (2006.01) |
| ***B26D 7/08*** | (2006.01) |
| ***B26D 1/03*** | (2006.01) |
| ***B26D 3/28*** | (2006.01) |

(52) U.S. Cl.

CPC ..... *B26D 7/0691* (2013.01); *B26D 7/08* (2013.01); *B26D 1/03* (2013.01); *B26D 3/28* (2013.01)

(58) Field of Classification Search

CPC ..... B26D 7/00; B26D 7/2628; B26D 7/08; B26D 1/36; B26D 7/0691; B26D 3/28; B26D 1/03; B26D 1/02; B26D 3/22; Y10T 83/6473; Y10T 83/6475; Y10T 83/655; Y10T 83/6574; Y10T 83/6667

See application file for complete search history.

(56) References Cited

U.S. PATENT DOCUMENTS

| | | | | | |
|---|---|---|---|---|---|
| 284,078 | A * | 8/1883 | Sherman | B26D 3/11 | 83/865 |
| 2,961,024 | A * | 11/1960 | Urschel | B26D 1/03 | 83/403 |
| 3,139,128 | A * | 6/1964 | Urschel | B26D 1/0006 | 83/111 |
| 3,139,130 | A * | 6/1964 | Urschel | B26D 1/03 | 83/13 |
| 3,255,646 | A * | 6/1966 | Urschel | B23P 15/40 | 76/101.1 |

(Continued)

*Primary Examiner* — Jonathan G Riley

(74) *Attorney, Agent, or Firm* — Hartman Global IP Law; Gary M. Hartman; Domenica N. S. Hartman

(57) ABSTRACT

Methods and equipment for cutting products, including food products. Such equipment includes an impeller adapted to be coaxially mounted within an annular-shaped cutting head for rotation about an axis of the cutting head in a rotational direction relative to the cutting head. The impeller includes a base and ring spaced axially from each other, at least a first intermediate plate disposed between the base and the ring so as to define at least first and second tier levels within the impeller, and paddles disposed between the base and the ring and within the first and second tier levels. The first intermediate plate has an opening therein that defines a passage between the first and second tier levels. The impeller further has pockets defined by and between immediately adjacent pairs of paddles within each tier level.

16 Claims, 7 Drawing Sheets

(56) References Cited

U.S. PATENT DOCUMENTS

| | | | | | |
|---|---|---|---|---|---|
| 4,196,660 | A * | 4/1980 | Steinberg | A47J 36/16 | 426/438 |
| 4,391,172 | A * | 7/1983 | Galland | B26D 1/02 | 83/403 |
| 4,601,227 | A * | 7/1986 | Fitzwater | B26D 3/22 | 426/144 |
| 4,604,925 | A * | 8/1986 | Wisdom | B26D 1/03 | 144/162.1 |
| 4,625,606 | A * | 12/1986 | Pinegar | B26D 3/22 | 83/403 |
| 5,687,921 | A * | 11/1997 | Moreels | B02C 18/086 | 241/240 |
| 6,883,411 | B2 * | 4/2005 | Arrasmith | B26D 1/02 | 416/187 |
| 7,223,431 | B2 * | 5/2007 | Owens | A01J 27/04 | 241/24.26 |
| 7,658,133 | B2 * | 2/2010 | Jacko | B26D 1/03 | 83/403 |
| 8,109,188 | B2 * | 2/2012 | Bellmunt-Molins | B26D 1/0006 | 426/144 |
| 9,193,086 | B2 * | 11/2015 | Jacko | B26D 7/2614 | |
| 2010/0263510 | A1 * | 10/2010 | Klockow | B26D 1/02 | 83/162 |
| 2014/0041531 | A1 * | 2/2014 | Bucks | B26D 5/00 | 99/403 |
| 2014/0116213 | A1 * | 5/2014 | King | B26D 7/0691 | 83/13 |
| 2014/0230621 | A1 * | 8/2014 | Bucks | B26D 1/36 | 83/403 |
| 2016/0067877 | A1 * | 3/2016 | Cogan | B26D 7/2614 | 83/13 |
| 2017/0072579 | A1 * | 3/2017 | Reis | B26D 3/10 | |

* cited by examiner

MACHINES AND METHODS FOR CUTTING PRODUCTS AND IMPELLERS THEREFOR

CROSS REFERENCE TO RELATED APPLICATIONS

This application claims the benefit of U.S. Provisional Application No. 62/086,782, filed Dec. 3, 2014, the contents of which are incorporated herein by reference.

BACKGROUND OF THE INVENTION

The present invention generally relates to methods and machines for cutting products. The invention particularly relates to machines equipped with an impeller adapted to transport products to at least one knife suitable for cutting the product, wherein the impeller is capable of transporting and orienting products that are relatively small, for example, the size of a small potato and smaller.

Various types of equipment are known for slicing, shredding and granulating food products, such as vegetable, fruit, dairy, and meat products. A widely used line of machines for this purpose is commercially available from Urschel Laboratories, Inc., under the name Urschel Model CC®, an embodiment of which is represented in FIG. 1. The Model CC® machine line provides versions of centrifugal-type slicers capable of producing uniform slices, strip cuts, shreds and granulations of a wide variety of products at high production capacities. When used to produce potato slices for potato chips, the Model CC® line of machines can make use of substantially round potatoes to produce the desired circular chip shape with a minimum amount of scrap.

The Model CC® machine 10 schematically represented in FIG. 1 includes a cutting head 12 mounted on a support ring 15 above a gear box 16. A housing 18 contains a shaft coupled to the gear box 16 that rotates an impeller 14 within the cutting head 12. Products are delivered to the cutting head 12 and impeller 14 through a feed hopper 11 located above the cutting head 12. In operation, the impeller 14 is coaxially mounted within the cutting head 12, which is generally annular-shaped with cutting knives (not shown) mounted at its perimeter. The impeller 14 rotates within the cutting head 12, while the latter remains stationary. The hopper 11 delivers products to the middle of the impeller 14, and centrifugal force causes the products to move outward into engagement with the knives of the cutting head 12. Further descriptions pertaining to the construction and operation of Model CC® machines, including improved embodiments thereof, are contained in U.S. Pat. Nos. 5,694,824 and 6,968,765, the entire contents of which are incorporated herein by reference.

FIG. 2 is a perspective view of a cutting head 12 and FIGS. 3 and 4 are perspective and cross-sectional views, respectively, of an impeller 14 of types that can be used in the Model CC® machine of FIG. 1. Referring to FIG. 2, each knife 13 of the cutting head 12 projects radially inward toward the interior of the cutting head 12, generally in a direction opposite the rotation of the impeller 14 within the cutting head 12, and defines a cutting edge at its radially innermost extremity. As represented in FIGS. 3 and 4, the impeller 14 comprises generally radially-oriented paddles 28 disposed between a base 30 and an upper ring 32, the latter being omitted in FIG. 4 to reveal the interior of the impeller 14 and orientations of the paddles 28. A frustoconical-shaped flange 34 extends in a generally axial direction from the ring 32 to define an opening 36 through which food products enter the impeller 14. The paddles 28 have faces 38 that engage and direct the products (e.g., potatoes) 39 radially outward towards and against the knives 13 of the cutting head 12 as the impeller 14 rotates. The cutting head 12 shown in FIG. 2 comprises a lower support ring 18, an upper support ring 20, and circumferentially-spaced support segments (shoes) 22. The knives 13 of the cutting head 12 are individually secured with clamping assemblies 26 to the shoes 22. Each clamping assembly 26 includes a knife holder 26A mounted to the radially inward-facing side of a shoe 22, and a clamp 26B mounted on the radially outward-facing side of a shoe 22 to secure the knife 13 to the knife holder 26A. The shoes 22 are represented as being secured with bolts 25 to the support rings 18 and 20. The shoes 22 are equipped with coaxial pivot pins (not shown) that engage holes in the support rings 18 and 20. By pivoting on its pins, the orientation of a shoe 22 can be adjusted to alter the radial location of the cutting edge of its knife 13 with respect to the axis of the cutting head 12, thereby controlling the thickness of the sliced product. As an example, adjustment can be achieved with an adjusting screw and/or pin 24 located circumferentially behind the pivot pins. FIG. 2 further shows optional gate insert strips 23 mounted to each shoe 22, which the product crosses prior to encountering the knife 13 mounted to the succeeding shoe 22.

The knives 13 shown in FIG. 2 are depicted as having straight cutting edges for producing flat slices, though other shapes are also used to produce sliced, strip-cut, shredded and granulated products. For example, the knives 13 can have cutting edges that define a periodic pattern of peaks and valleys when viewed edgewise. The periodic pattern can be characterized by sharp peaks and valleys, or a more corrugated or sinusoidal shape characterized by more rounded peaks and valleys when viewed edgewise. If the peaks and valleys of each knife 13 are aligned with those of the preceding knife 13, slices are produced in which each peak on one surface of a slice corresponds to a valley on the opposite surface of the slice, such that the slices are substantially uniform in thickness but have a cross-sectional shape that is characterized by sharp peaks and valleys ("V-slices") or a more corrugated or sinusoidal shape (crinkle slices), collectively referred to herein as periodic shapes. Alternatively, shredded product can be produced if each peak of each knife 13 is aligned with a valley of the preceding knife 13, and waffle/lattice-cut product can be produced by intentionally making off-axis alignment cuts with a periodic-shaped knife, for example, by crosscutting a product at two different angles, typically ninety degrees apart. In addition, strip-cut and granulated products can be produced with the use of additional knives and/or cutting wheels located downstream of the knives 13. Whether a sliced, strip-cut, shredded, granulated, or waffle-cut product is desired will depend on the intended use of the product.

Equipment currently available for cutting product, such as those represented in FIGS. 1-4, are well suited for producing slices of a wide variety of food products. Even so, further improvements and versatility are desirable, particularly for producing slices, strip cuts, shreds and granulations from a wider variety of products at high production capacities. For example, under certain conditions it is desirable to process food products that are smaller than potatoes of sizes commonly used to produce potato chips, for example, food products having diameters of less than two to three inches. Particular but nonlimiting examples include food products such as almonds, coffee beans, strawberries, mushrooms, etc. For smaller products such as these, the products tend to encounter only a limited portion of each knife 13 at the lower end of the cutting head 12 (as viewed in FIG. 2). It may also be desirable for the impeller 14 to deliver smaller elongate products (for example, almonds, coffee beans) so that their major dimension has a particular orientation to the cutting head 12, for example, so that the major axis of each product is oriented to be functionally tangent to the outer diameter of the impeller 14, so that a majority of the cuts through the products are lengthwise and nearly parallel to their major axes.

BRIEF DESCRIPTION OF THE INVENTION

The present invention provides methods and equipment suitable for cutting products.

According to one aspect of the invention, an impeller is adapted to be coaxially mounted within an annular-shaped cutting head for rotation about an axis of the cutting head in a rotational direction relative to the cutting head. The impeller includes a base and a ring spaced axially from each other, at least a first intermediate plate disposed between the base and the ring so as to define at least first and second tier levels within the impeller, and paddles disposed between the base and the ring. At least a portion of each paddle is disposed within at least one of the first and second tier levels. The first tier level is between the base and the first intermediate plate, and the second tier level is between the first intermediate plate and the ring. The first intermediate plate has an opening therein that defines a portion of a passage between the first and second tier levels. Each paddle has a radially outer extremity adjacent an outer perimeter of the impeller, an oppositely-disposed radially inner extremity, and a face between the radially inner and outer extremities and facing the rotational direction of the impeller. The impeller further has pockets defined within each of the first and second tier levels. Each pocket is disposed between a pair of the paddles that are immediately adjacent each other in the rotational direction of the impeller, and each pocket is further delimited in an axial direction of the impeller by the base, the ring, and the first intermediate plate.

According to another aspect of the invention, a machine adapted to cut products includes an impeller of a type described above, and further includes a cutting head having at least one knife extending radially inward toward the impeller in a direction opposite the rotational direction of the impeller.

Other aspects of the invention include methods of using impellers and operating machines of the types described above to cut products, including but not limited to food products. Such a method includes rotating the impeller, supplying products to the impeller through an entrance defined by the ring, stratifying the products among the first and second tiers with the first intermediate plate and the opening therein, and propelling the products into the pockets through action of rotating the impeller.

Technical effects of impellers, machines, and methods described above preferably include the ability of an impeller to vertically stratify the products as they are delivered to a cutting head located at and surrounding the outer perimeter of the impeller, so that a greater portion of the length of each knife is used to cut the products, particularly if the products are relatively small, for example, food products having diameters of less than two or three inches. Other technical effects of the impellers, machines, and methods include the ability of the impeller to deliver smaller elongate products (for example, almonds, coffee beans) so that their major dimension has a particular orientation to the cutting head, for example, so that a majority of the cuts through the products are lengthwise and nearly parallel to their major axes.

Other aspects and advantages of this invention will be better appreciated from the following detailed description.

DETAILED DESCRIPTION OF THE INVENTION

Figure 1:
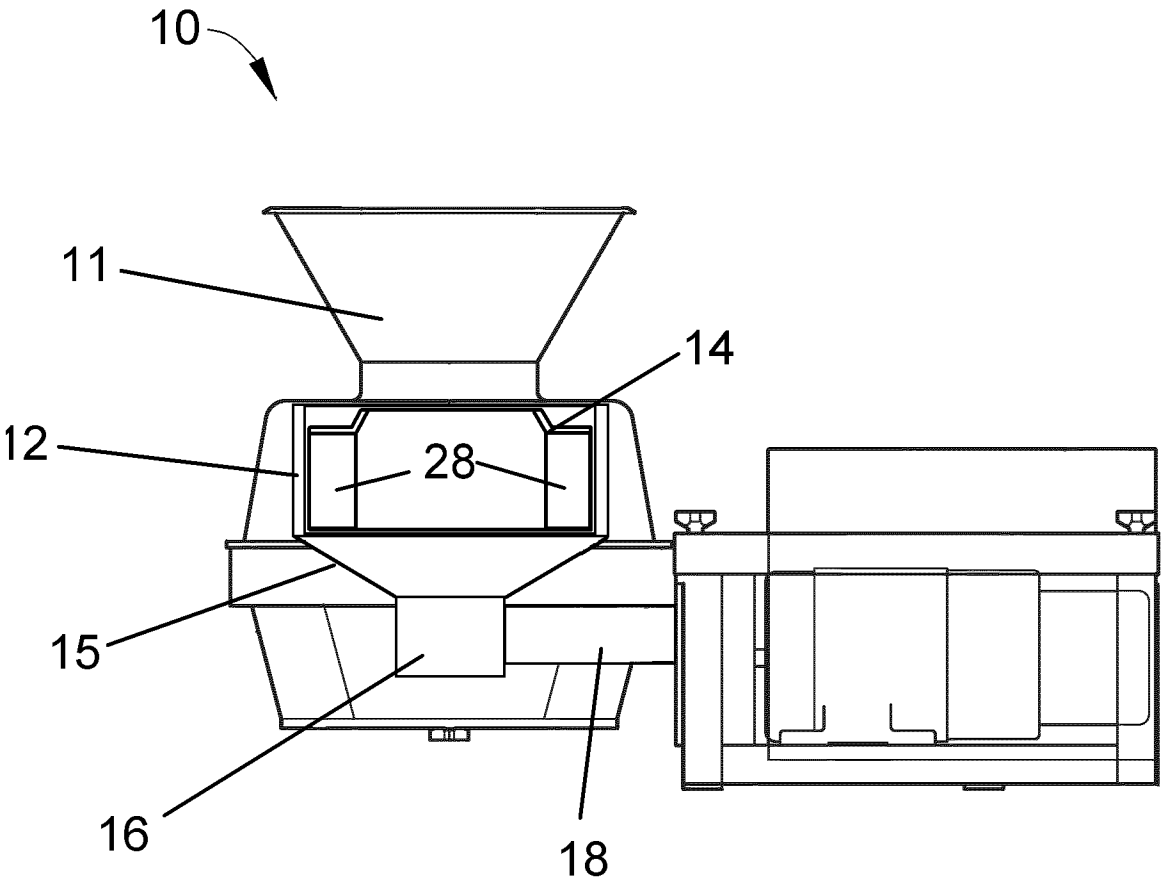
FIG. 1 PRIOR ART
FIG. 1 is a side view in partial cross-section representing a cutting machine known in the art.
Figure 2:
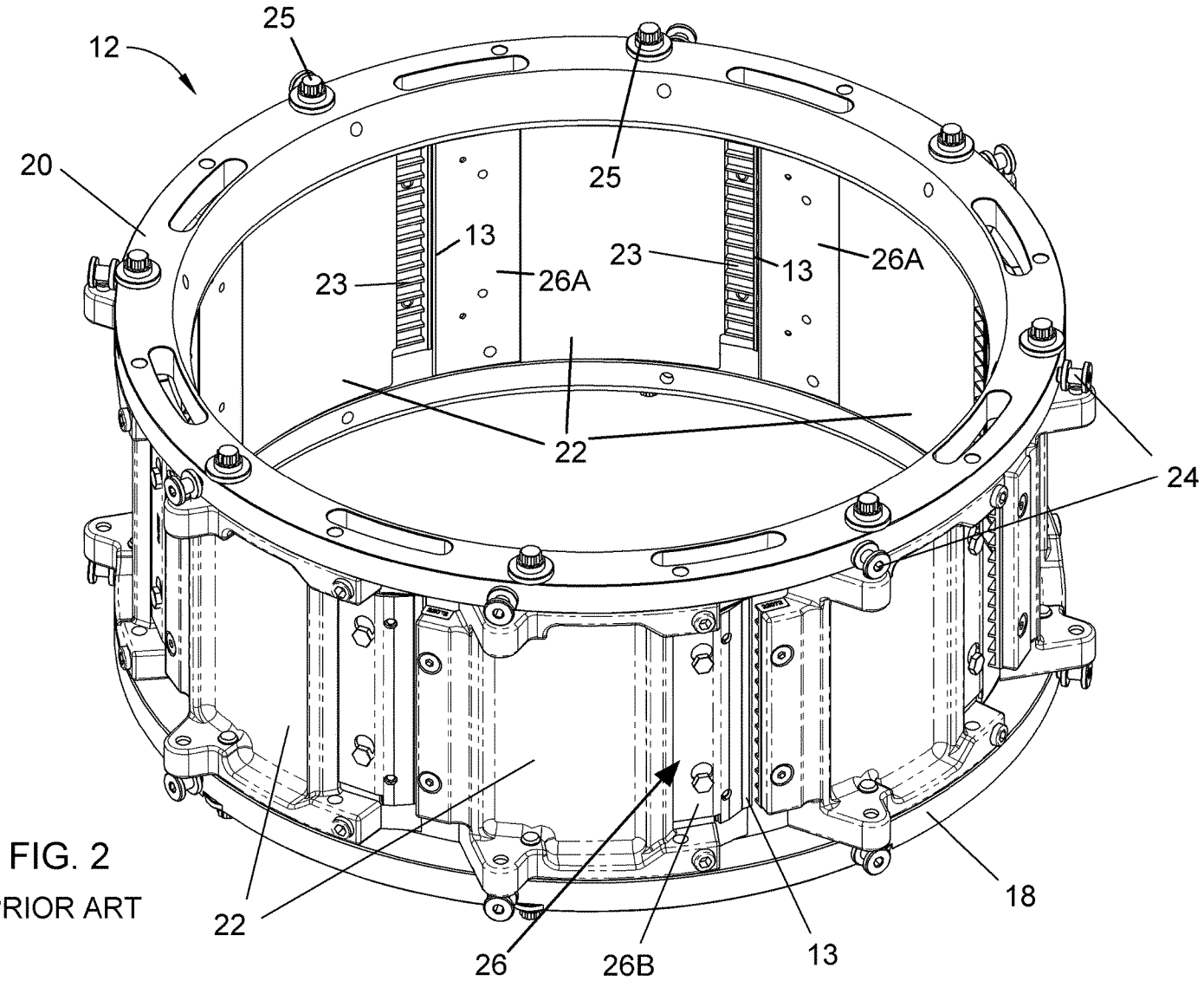
FIG. 2 PRIOR ART
FIG. 2 is a perspective view representing a cutting head of a type suitable for use with the cutting machine of FIG. 1.
Figure 4:
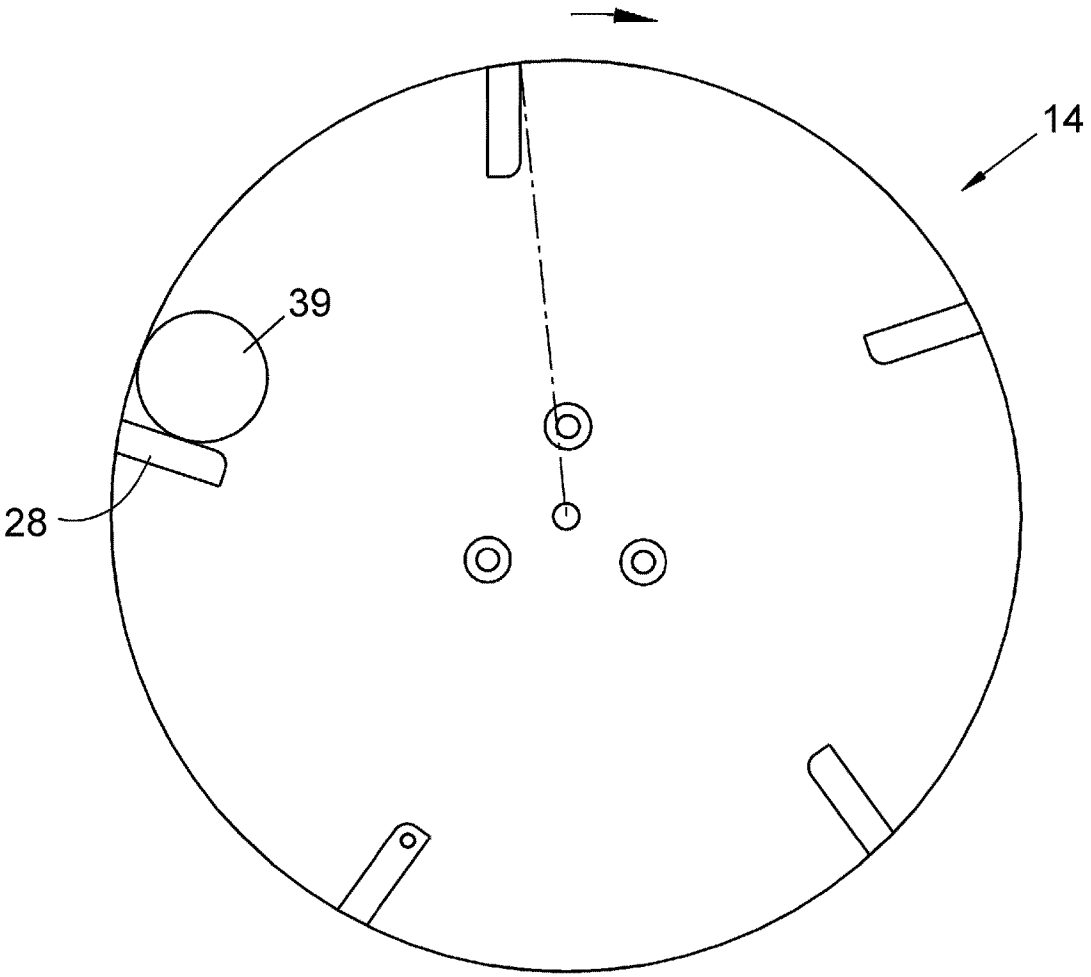
FIG. 4 PRIOR ART
FIG. 4 is a cross-sectional view of the impeller of FIG. 3 indicating its rotation by which products are forced radially outward toward, for example, the cutting head of FIG. 2.
Figure 5:
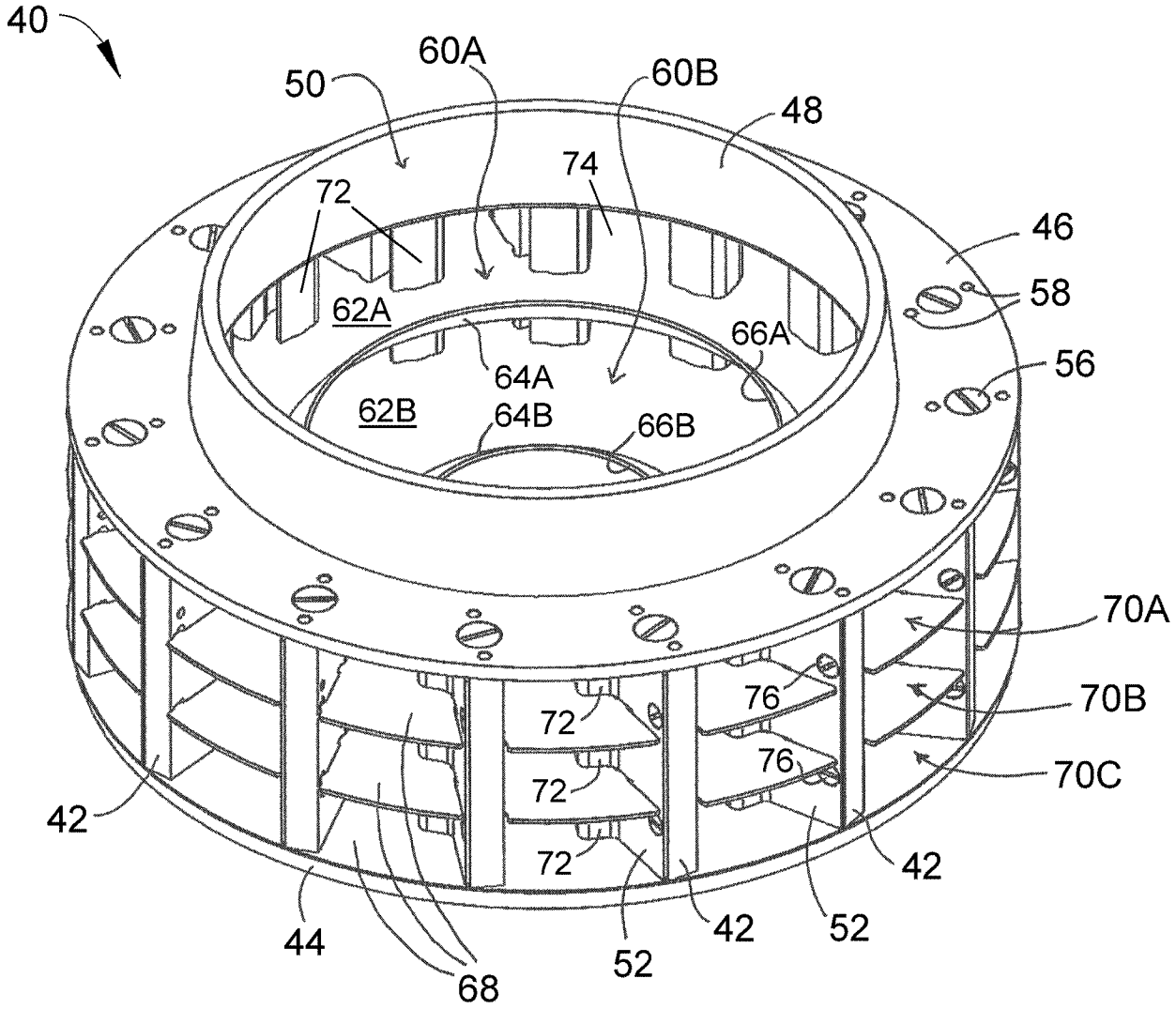
FIG. 5 is a perspective view representing an impeller in accordance with a nonlimiting embodiment of the invention and suitable for use with the cutting machine of FIG. 1 and cutting head of FIG. 2.
Figure 6:
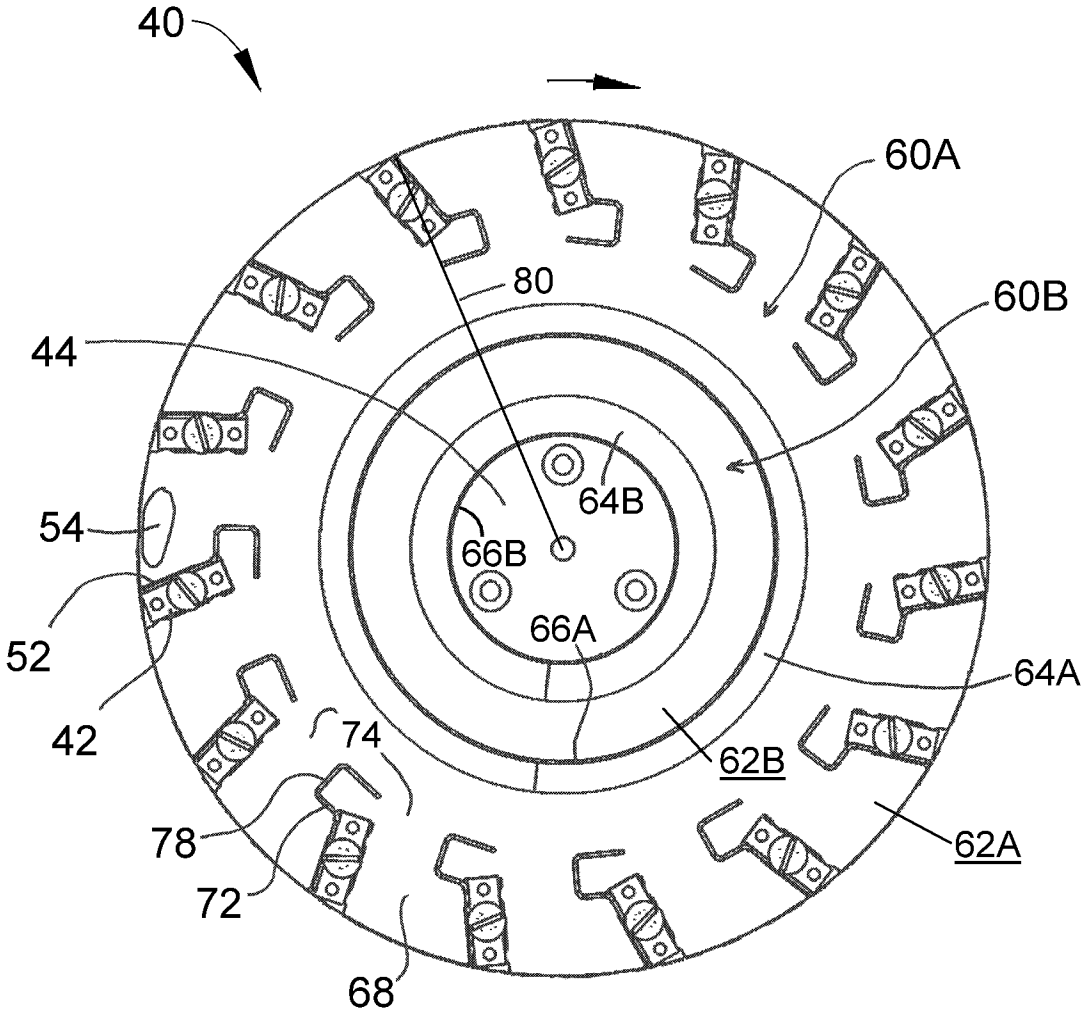
FIG. 6 is a plan view of the impeller of FIG. 5.

FIGS. 5 and 6 show an impeller 40 in accordance with a nonlimiting embodiment of the present invention. As indicated in FIG. 6, the impeller 40 is configured for rotation, for example, within a cutting head similar to the cutting head 12 of FIG. 2, as well as other configurations of cutting heads having an annular shape within which the impeller 40 can be installed for rotation, as discussed above in reference to FIGS. 1 through 4. The impeller 40 will be described below in reference to the cutting head 12 of FIG. 2, though it should be understood that the impeller 40 can find suitable use in cutting heads other than what is shown in FIG. 2.

Figure 3:
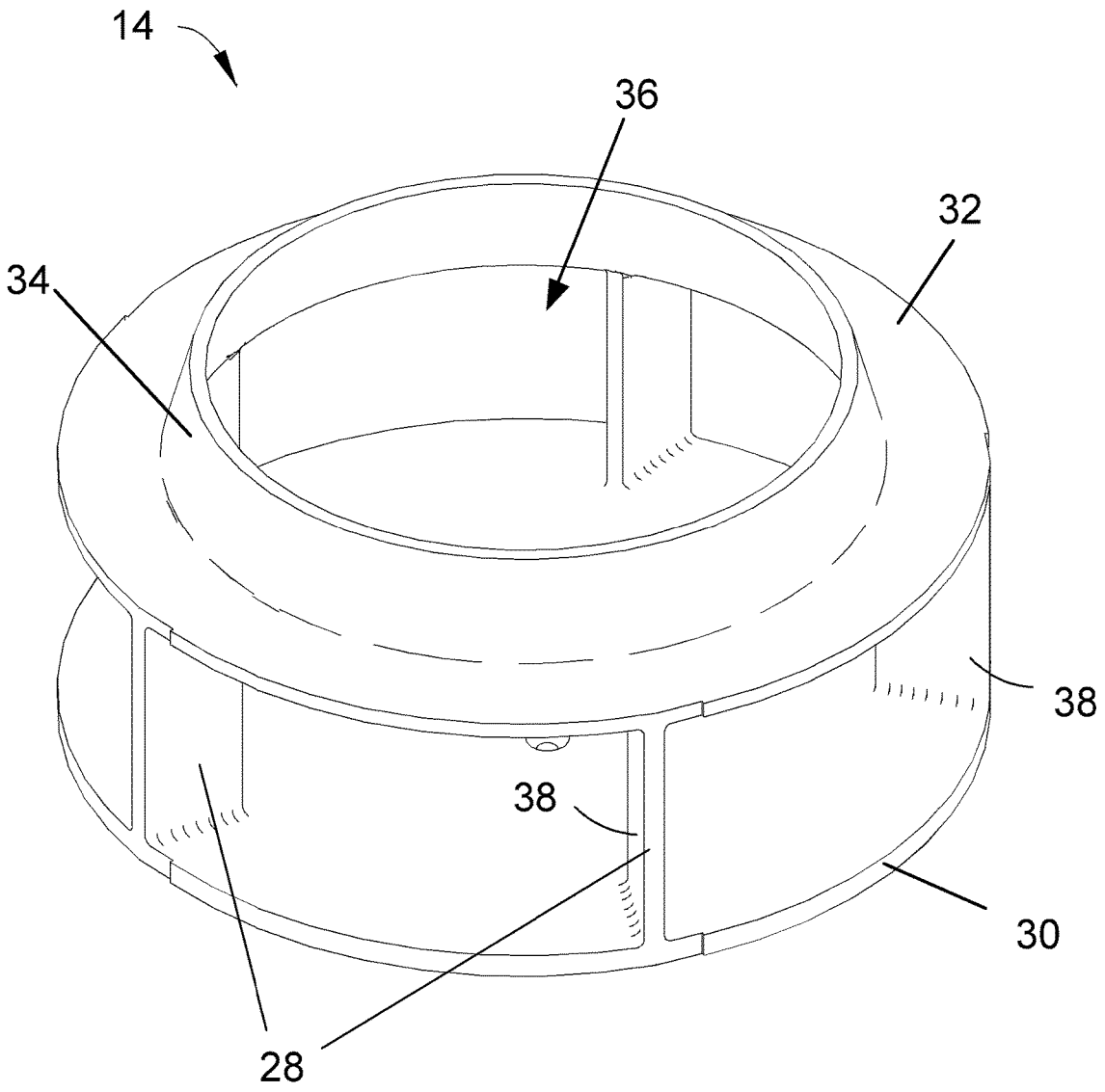
FIG. 3 PRIOR ART
FIG. 3 is a perspective view representing an impeller of a type suitable for use with the cutting machine of FIG. 1 and cutting head of FIG. 2.

Similar to the impeller 14 of FIGS. 3 and 4, the impeller 40 is shown in FIGS. 5 and 6 as comprising generally radially-oriented paddles 42 disposed between a base 44 and an upper ring 46 (not shown in FIG. 6 to reveal the interior of the impeller 40). The base 44 and ring 46 are represented in the embodiment of FIG. 5 as being parallel to each other and perpendicular to the axis 41 of rotation of the impeller 40. A frustoconical-shaped flange 48 extends in a generally axial direction from the ring 46 to define an entrance or opening 50 through which products 54 (FIG. 6) enter the impeller 40. Each paddle 42 has a radially outermost extremity adjacent and preferably contiguous with the outer perimeter of the impeller 40, an oppositely-disposed radially innermost extremity, and a face 52 between the radially inner and outer extremities and facing the rotational direction of the impeller 40. The faces 52 of the paddles 42 define surfaces that engage and direct the products 54 radially outward toward and against the cutting head 12 surrounding the impeller 40 as the impeller 40 rotates, and in particular to encounter the knives 13 of the cutting head 12 where the products 54 undergo a slicing operation.

FIGS. 5 and 6 show the face 52 of each paddle 42 as being a planar surface, though other surface configurations are possible. Suitable dimensions for the paddles 42 will depend in part on the size of the products being processed, and therefore can vary considerably. For accommodating products with diameters less than two or three inches (about five or eight centimeters), a suitable width for each paddle 42 is about 1.5 inches as measured between the radially outermost and innermost extents of each paddle face 52 in a direction perpendicular to the axis 41 of the impeller 40. The number of paddles 42 within the impeller 40 can be varied, i.e., greater or less than the fifteen paddles 42 shown for the embodiment in FIGS. 5 and 6.

As evident from FIGS. 5 and 6, the paddles 42 differ in construction and configuration from the prior art paddles 28 of FIGS. 3 and 4. Because of the configuration of the paddles 42, the impeller 40 is preferably an assembly constructed of individually formed paddles 42 mounted and secured between the base 44 and ring 46. In the embodiment shown in FIGS. 5 and 6, each paddle 42 is individually mounted to the base 44 and ring 46 with bolts 56 and pins 58 that are received in corresponding holes formed in the base 44 and ring 46. As a result of its modular construction, the impeller 40 and its components can be formed by casting as well as other processes, and formed of various materials in addition to commonly-used MAB (manganese aluminum bronze) alloys.

The pitch of each paddle face 52 is shown in FIG. 6 as being positive, meaning that the radially innermost extent of each paddle face 52 is angled toward the direction of rotation of the impeller 40 relative to a radial 80 of the impeller 40, as indicated for one of the paddles 42 in FIG. 6. Alternatively, the pitch of the paddle faces 52 could be negative (such as the orientation seen in FIG. 4) or neutral (meaning that the face 52 of each paddle 42 entirely lies on a radial (80) of the impeller 40). A single set of holes is represented as being provided for the bolts 56 and pins 58 of each paddle 42 so that the paddles 42 for a given impeller 40 are limited to having a negative, neutral, or positive pitch, as may be desired. Alternatively, multiple sets of mounting holes could be provided in the base 44 and ring 46 to enable reorientation of the pitch of each paddle 42 on the impeller 40.

In addition to the base 44 and ring 46, FIGS. 5 and 6 depict the impeller 40 as comprising intermediate plates 60A and 60B that are disposed between the base 44 and ring 46. In combination with the base 44 and ring 46, the intermediate plates 60A and 60B define tier levels within the impeller 40, each capable of receiving products. The plates 60A and 60B are represented as being oriented to be substantially parallel to each other and to the base 44 and ring 46, and therefore also perpendicular to the axis 41 of the impeller 40. Though two plates 60A and 60B are represented within the impeller 40, a single plate or more than two plates could be utilized. Each paddle 42 is preferably continuous between the base 44 and ring 46, and therefore passes through the intermediate plates 60A and 60B, as evident from FIG. 5. Alternatively, each paddle 42 depicted in FIG. 5 could be made up of multiple paddles, each entirely disposed within a single tier level of the impeller 40. In either case, the paddles 42 defined pockets 68 within each tier level, with each pocket 68 being disposed between a pair of paddles 42 that are immediately adjacent each other in the direction of rotation of the impeller 40. Each pocket 68 is also delimited in the axial direction of the impeller 40 by two of the base 44, ring 46, and intermediate plates 60A and 60B.

In the nonlimiting embodiment of FIGS. 5 and 6, the paddles 42 are equi-angularly spaced at the outer perimeter of the impeller 40, such that the pockets 68 are substantially identical. Also in the embodiment of FIGS. 5 and 6, two intermediate plates 60A and 60B define three tier levels 70A, 70B and 70C between the base 44 and ring 46. Each intermediate plate 60A and 60B has a generally annular shape that includes a substantially planar portion 62A and 62B, respectively, surrounding a frustoconical flange 64A and 64B, respectively, that extends in a generally axial direction from the planar portion 62A/62B. The flange 64A/64B of each plate 60A/60B defines an opening 66A or 66B that is concentric with the axis 41 of the impeller 40 and defines passages between the tiers 70A, 70B and 70C through which products are able to pass to enter one of the lower tier levels 70B and 70C beneath the opening 66A or 66B, such that the plates 60A and 60B include the ability to function as baffles. For example, a fraction of the products that enter the impeller 40 through its opening 50 (FIG. 5) will be captured within the upper tier level 70A defined between the upper intermediate plate 60A and the ring 46 as a result of encountering and being deflected by the planar portion 62A or flange 64A of the upper intermediate plate 60A, whereas another fraction of the products that enter the impeller 40 will pass through the opening 66A in the upper intermediate plate 60A but then be captured within the middle tier level 70B defined between the upper and lower intermediate plates 60A and 60B as a result of encountering and being deflected by the planar portion 62B or flange 64B of the lower intermediate plate 60B, whose opening 66B is smaller than the opening 66A in the plate 60A. The remaining portion of the products that is not captured within the tier levels 70A and 70B will pass through the opening 66B of the lower intermediate plate 60B and enter the lower tier level 70C defined between the base 44 and lower intermediate plate 60B.

In view of the above, the intermediate plates 60A and 60B serve to axially (vertically) stratify the distribution of products within the impeller 40, with the result that a greater portion of the length of each cutting head knife 13 will be used to slice the products than would otherwise likely occur. It should be appreciated that the size and number of paddles 42 and plates 60A and 60B can be varied to influence the stratification and distribution of products within the impeller 40. In addition, the axial distances between the base 44, ring 46, and plates 60A and 60B can be tailored to influence the stratification and distribution of products within the impeller 40. For example, it may be determined that increasingly greater or smaller axial spacings are desired between the base 44 and plate 60B, between the plates 60A and 60B, and between the plate 60A and ring 46 in order to promote a uniform distribution among the pockets 68 of the tiers 70A, 70B and 70C.

Figure 7:
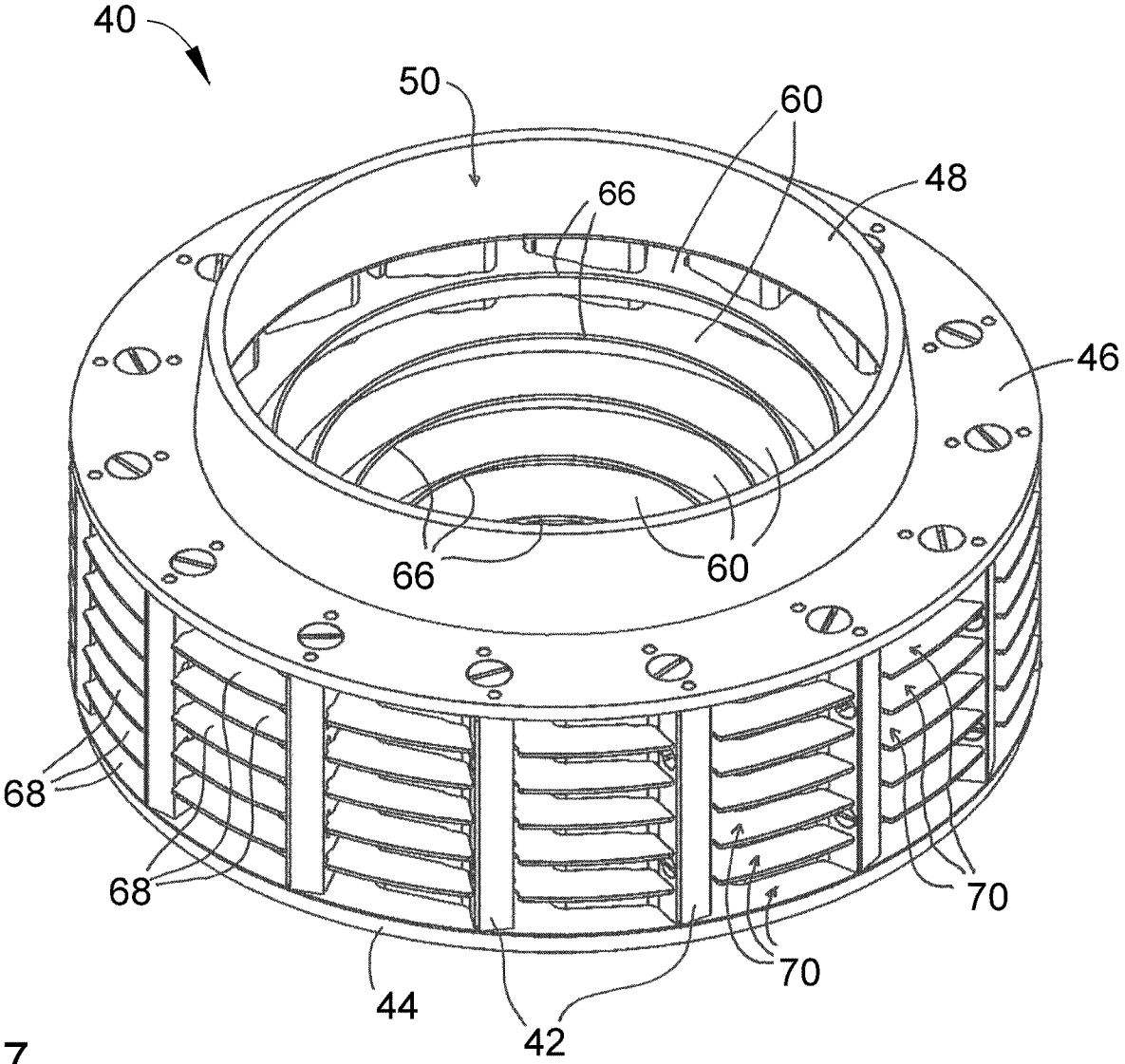
FIG. 7 is a perspective view representing an impeller in accordance with another nonlimiting embodiment of the invention and suitable for use with the cutting machine of FIG. 1 and cutting head of FIG. 2.

Generally, a greater portion of the knife lengths will actively participate in slicing of products with increasingly greater numbers of tier levels defined within the impeller 40 by intermediate plates. For example, FIG. 7 depicts an impeller 40 that is similar to the impeller 40 of FIGS. 5 and 6 except for the number of intermediate plates 60 and tier levels 70 defined within the impeller 40. The relative sizes of the openings 66 within the plates 60A and 60B (60 in FIG. 7) will influence the relative fractions of products that enter the tier levels 70A, 70B and 70C (70 in FIG. 7), and as such their relative sizes can be tailored to promote a desired stratification of products among the tier levels 70A, 70B, and 70C (70 in FIG. 7). Such a capability is particularly advantageous when processing relatively small food products (e.g., in comparison to potatoes), nonlimiting examples of which include almonds, coffee beans, strawberries, mushrooms, etc., as greater stratification enables these smaller products to encounter a greater portion of the length of each knife 13 in the axial direction of the cutting head 12 (as viewed in FIG. 2). The size of the impeller 40 can also be tailored for processing different sized products, such that the size of the pockets 68 can be tailored to receive and orient a particular product of a particular size during the process of being sequentially cut by the circumferential series of knives 13 mounted to the cutting head 12 in which the impeller 40 is installed and rotating. In addition, it is believed that the surface conditions of the base 44 and plates 60A and 60B (60 in FIG. 7) may affect the manner and speed with which products are transferred to the pockets 68 and stabilized within the pockets 68. For example, the surfaces of the base 44 and plates 60A and 60B (60 in FIG. 7) facing the opening 50 of the impeller 40 may be blast finished, polished, and/or grooved for this purpose to promote a desired effect. It is further believed that the manner and speed with which products can be transferred to the pockets 68 and stabilized within the pockets 68 can be promoted by ensuring that at least the planar portions 62A and 62B (62 in FIG. 7) of the plates 60A and 60B (60 in FIG. 7) are parallel to the base 44 and/or perpendicular to the axis 41 of the impeller 40.

FIGS. 5 and 6 further show the impeller 40 equipped with attachments 72 extending from the radially innermost extent of each paddle 42. As evident from FIG. 5, each attachment 72 forms a restricted opening 74 to a pocket 68 at the radially innermost extents of an adjacent pair of paddles 42 that form the pocket 68. The openings 74 are restricted in the sense that each has a circumferential extent (i.e., its width in the direction of rotation of the impeller 40) that is narrower than the circumferential extent of its corresponding pocket 68 (i.e., the distance between the pair of paddles 42 that form the pocket 68). The intended purpose of the restricted opening 74 is to promote the ability of the impeller 40 to deliver relatively small elongate products (for example, almonds, coffee beans, etc.) so that their major dimension has a particular orientation to the cutting head 12, preferably so that the major axis of each product is oriented to be functionally tangent to the outer diameter of the impeller 40, so that a majority of the cuts through the products are lengthwise and nearly parallel to their major axes. The attachments 72 shown in FIG. 6 reduce the entrances to the pockets 68 by roughly twenty-five percent, though lesser and greater restrictions are foreseeable.

Along with the paddle 42 to which it is attached, each attachment 72 may be continuous between the base 44 and ring 46. In other words, a single attachment 72 is attached to each paddle 42 and passes through the intermediate plates 60A and 60B. Alternatively, multiple attachments 72 may be attached to each paddle 42, which each attachment 72 disposed between an adjacent pair of the base 44, ring 46, and plates 60A and 60B. Each attachment 72 is shown as being attached to or at the face 52 of its corresponding paddle 42, for example, with bolts 76, though other locations and means for attachment are foreseeable. In addition, a portion of each attachment 72 is represented as having a U-shaped profile when viewed along the axial direction of the impeller 40, though other shapes are foreseeable. The U-shaped portions of the attachments 72 shown in FIG. 6 present a flat or blunt surface 78 to products entering the pockets 68. Each restricted opening 74 is defined by and between one of the blunt surfaces 78 and a preceding paddle 42 in the rotational direction. Each blunt surface 78 is represented as being roughly parallel to the preceding paddle 42, such that the resulting restricted opening 74 has a generally uniform width with the preceding paddle 42 to assist in orienting elongated products. The blunt surfaces 78 may also reduce the risk of damage to the products, and may be used as an attachment point for a flexible component to further reduce impact damage. By forming the attachments 72 from a suitable sheet material, the shapes of the attachments 72 can be readily tailored for compatibility with the particular product being processed.

While the invention has been described in terms of specific embodiments, it is apparent that other forms could be adopted by one skilled in the art. For example, the impeller 40 and cutting head 12 could differ in appearance and construction from the embodiments shown in the figures, the functions of each component of the impeller 40 and cutting head 12 could be performed by components of different construction but capable of a similar (though not necessarily equivalent) function, and various materials and processes could be used to fabricate the impeller 40 and cutting head 12 and their components. In addition, the nonlimiting embodiment of the cutting head 12 shown in FIG. 2 is particularly adapted to cut products into slices, though it is foreseeable that the impeller 40 could be used in combination with a cutting head adapted for cutting other materials. Therefore, the scope of the invention is to be limited only by the following claims.

The invention claimed is:

1. An impeller adapted to be coaxially mounted within an annular-shaped cutting head for rotation about a vertical rotational axis thereof in a rotational direction relative to the cutting head, the impeller comprising:

a base and a ring spaced axially from each other, the ring defining an entrance to the impeller that surrounds the rotational axis of the impeller;

one or more intermediate plates disposed between the base and the ring and comprising at least a first intermediate plate so as to define at least first and second tier levels within the impeller, the first intermediate plate being closer to the entrance of the impeller than any other of the intermediate plates, the first tier level being between the ring and the first intermediate plate, the second tier level being between the first intermediate plate and the base, the first intermediate plate having an annular shape that defines an opening that is concentric with the rotational axis of the impeller, is smaller than the entrance in the ring, and defines a passage between the first and second tier levels and through which products are able to pass to enter the second tier level beneath the opening from the first tier level, the passage being disposed on and encompassing the rotational axis of the impeller such that the rotational axis of the impeller lies within the passage, the first intermediate plate functioning as a baffle whereby a fraction of the products entering the impeller through the entrance is captured within the first tier level as a result of encountering and being deflected by the first intermediate plate and a second fraction of the products entering the impeller passes through the opening in the first intermediate plate and is captured within the second tier level beneath the opening of the first intermediate plate;

paddles disposed between the base and the ring, at least a portion of each paddle being disposed within at least one of the first and second tier levels, each of the paddles having a radially outer extremity adjacent an outer perimeter of the impeller, an oppositely-disposed radially innermost extremity, and a face between the radially innermost and outer extremities and facing the rotational direction of the impeller; and pockets defined within each of the first and second tier levels, each pocket being disposed between a pair of the paddles that are immediately adjacent each other in the rotational direction of the impeller, the pockets being delimited in an axial direction of the impeller by the base, the ring, and at least the first intermediate plate;

wherein the first intermediate plate includes a planar portion that surrounds the passage through the first intermediate plate, and the planar portion of the first intermediate plate surrounds a frustoconical flange that extends in the axial direction from the planar portion and surrounds the passage through the first intermediate plate.

2. The impeller of claim 1, wherein each paddle extends between the base and the ring and passes through the first intermediate plate so that portions of the paddle are disposed within the first and second tier levels.

3. The impeller of claim 1, the intermediate plates further comprising at least a second intermediate plate disposed between the first intermediate plate and the base so as to define at least a third tier level within the impeller between the second intermediate plate and the base, the second intermediate plate having an annular shape that defines an opening that is concentric with the rotational axis of the impeller, is smaller than the opening in the first intermediate plate, and defines a second passage between the second and third tier levels and through which products are able to pass to enter the third tier level beneath the opening from the second tier level, the passage being disposed on and encompassing the rotational axis of the impeller such that the rotational axis of the impeller lies within the passage, the second intermediate plate functioning as a second baffle whereby the second fraction of the products is captured within the second tier level defined between the first and second intermediate plates as a result of encountering and being deflected by the second intermediate plate and a third fraction of the products entering the impeller through the entrance passes through the opening in the second intermediate plate and is captured within the third tier level beneath the opening of the second intermediate plate.

4. The impeller of claim 3, wherein the paddles pass through the first and second intermediate plates so that a portion of each paddle is disposed within each of the first, second, and third tier levels.

5. The impeller of claim 3, wherein the first intermediate plate has a planar portion that surrounds the passage therethrough and the second intermediate plate has a planar portion that surrounds the second passage therethrough.

6. The impeller of claim 5, wherein the planar portion of the second intermediate plate surrounds a frustoconical flange that extends in the axial direction from the planar portion and surrounds the second passage through the second intermediate plate.

7. The impeller of claim 1, wherein the paddles are equi-angularly spaced at the outer perimeter of the impeller and the pockets are identical.

8. The impeller of claim 1, further comprising attachments that are each attached to a corresponding one of the paddles and extend in the rotational direction from the radially innermost extremity of the corresponding paddle, each of the attachments forming a restricted opening to a corresponding one of the pockets between the corresponding paddle from which the attachment extends and a preceding one of the paddles that precedes the corresponding paddle in the rotational direction, the restricted opening being narrower than a distance between the radially innermost extremities of the corresponding paddle from which the attachment extends and the preceding paddle that precedes the corresponding paddle in the direction of rotation of the impeller.

9. The impeller of claim 8, wherein each of the attachments has a blunt surface and each of the restricted openings is defined by and between one of the blunt surfaces and the preceding paddle that precedes the corresponding paddle from which the attachment extends.

10. The impeller of claim 9, wherein each of the blunt surfaces is parallel to the preceding paddle that precedes the corresponding paddle from which the attachment extends and the restricted opening defined thereby has a generally uniform width in the rotational direction.

11. The impeller of claim 8, wherein the attachments define the faces of the paddles.

12. A machine comprising the impeller of claim 1, the machine comprising an annular-shaped cutting head having at least one knife extending radially inward toward the impeller in a direction opposite the rotational direction of the impeller.

13. A method of using the impeller of claim 1, the method comprising:

rotating the impeller;

supplying products to the impeller through the entrance defined by the ring;

vertically stratifying the products among the first and second tier levels with the first intermediate plate and the passage therethrough;

propelling the products into the pockets through action of rotating the impeller; and orienting the products to have a major axis functionally tangent to the outer perimeter of the impeller, wherein the orienting step is performed with attachments that are each attached to a corresponding one of the paddles and extend in the rotational direction from the radially innermost extremity of the corresponding paddle, each of the attachments forming a restricted opening to a corresponding one of the pockets between the corresponding paddle from which the attachment extends and a preceding one of the paddles that precedes the corresponding paddle in the rotational direction, and the restricted opening is narrower than a distance between the radially innermost extremities of the corresponding paddle from which the attachment extends and the preceding paddle that precedes the corresponding paddle in the direction of rotation of the impeller.

14. An impeller adapted to be coaxially mounted within an annular-shaped cutting head for rotation about a vertical rotational axis thereof in a rotational direction relative to the cutting head, the impeller comprising:

a base and a ring spaced axially from each other, the ring defining an entrance to the impeller that surrounds the rotational axis of the impeller;

one or more intermediate plates disposed between the base and the ring and comprising at least a first intermediate plate so as to define at least first and second tier levels within the impeller, the first intermediate plate being closer to the entrance of the impeller than any other of the intermediate plates, the first tier level being between the ring and the first intermediate plate, the second tier level being between the first intermediate plate and the base, the first intermediate plate having an annular shape that defines an opening that is concentric with the rotational axis of the impeller, is smaller than the entrance in the ring, and defines a passage between the first and second tier levels and through which products are able to pass to enter the second tier level beneath the opening from the first tier level, the passage being disposed on and encompassing the rotational axis of the impeller such that the rotational axis of the impeller lies within the passage, the first intermediate plate functioning as a baffle whereby a fraction of the products entering the impeller through the entrance is captured within the first tier level as a result of encountering and being deflected by the first intermediate plate and a second fraction of the products entering the impeller passes through the opening in the first intermediate plate and is captured within the second tier level beneath the opening of the first intermediate plate;

paddles disposed between the base and the ring, at least a portion of each paddle being disposed within at least one of the first and second tier levels, each of the paddles having a radially outer extremity adjacent an outer perimeter of the impeller, an oppositely-disposed radially innermost extremity, and a face between the radially innermost and outer extremities and facing the rotational direction of the impeller;

pockets defined within each of the first and second tier levels, each pocket being disposed between a pair of the paddles that are immediately adjacent each other in the rotational direction of the impeller so that each immediately adjacent pair of the paddles comprises a preceding paddle and a succeeding paddle in the rotational direction, the pockets being delimited in an axial direction of the impeller by the base, the ring, and at least the first intermediate plate; and attachments that are each attached to a corresponding one of the paddles and extend in the rotational direction from the radially innermost extremity of the corresponding paddle, each of the attachments forming a restricted opening to a corresponding one of the pockets between the corresponding paddle from which the attachment extends and the preceding paddle that precedes the corresponding paddle in the rotational direction, the restricted opening being narrower than a distance between the radially innermost extremity of the corresponding paddle from which the attachment extends and the radially innermost extremity of the preceding paddle that precedes the corresponding paddle in the direction of rotation of the impeller.

15. The impeller of claim 14, wherein each of the attachments has a blunt surface and each of the restricted openings is defined by and between one of the blunt surfaces and the preceding paddle that precedes the corresponding paddle from which the attachment extends.

16. The impeller of claim 15, wherein each of the blunt surfaces is parallel to the preceding paddle that precedes the corresponding paddle from which the attachment extends and the restricted opening defined thereby has a generally uniform width in the rotational direction.

* * * * *